US006827616B2

(12) United States Patent
Burg

(10) Patent No.: US 6,827,616 B2
(45) **Date of Patent: *Dec. 7, 2004**

(54) WATERJET PROPULSOR ENHANCEMENTS

(75) Inventor: Donald E. Burg, Miami, FL (US)

(73) Assignee: Paulette Renee Burg, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/267,077

(22) Filed: Oct. 8, 2002

(65) Prior Publication Data

US 2003/0036319 A1 Feb. 20, 2003

Related U.S. Application Data

(63) Continuation-in-part of application No. 09/702,905, filed on Oct. 26, 2000, now abandoned.

(51) Int. Cl.[7] ..... B63H 11/00
(52) U.S. Cl. ..... 440/38; 440/47

(58) Field of Search ..... 440/38, 46, 47, 440/41; 60/221, 222

(56) References Cited

U.S. PATENT DOCUMENTS

| | | | | | |
|---|---|---|---|---|---|
| 3,253,567 | A | * | 5/1966 | Patton, Jr. | 440/46 |
| 5,505,639 | A | * | 4/1996 | Burg | 440/42 |
| 5,509,832 | A | * | 4/1996 | Roos | 440/47 |
| 6,004,173 | A | * | 12/1999 | Schott | 440/38 |
| 6,629,866 | B2 | * | 10/2003 | Burg | 440/38 |

* cited by examiner

*Primary Examiner*—Ed Swinehart

(57) ABSTRACT

The instant invention presents enhancements to waterjet propulsors used for propelling marine vehicles including a way to bleed off aerated boundary layer water from the inlet of the waterjet propulsor, air fences to further help in preventing aerated boundary layer water from entering the inlet of the waterjet propulsor, and a way to preclude water from entering the waterjet's water inlet when the waterjet is not operating and the marine vehicle is moving forward at high speed.

31 Claims, 2 Drawing Sheets

WATERJET PROPULSOR ENHANCEMENTS

CROSS REFERENCE TO OTHER APPLICATIONS

This application is a continuation-in-part to Applicant's earlier filed applications Ser. No. 09/702,905 filed Oct. 26, 2000, now abandoned, and Ser. No. 09/809,414 filed Mar. 15, 2001, now U.S. Pat. No. 6,629,866 issued Oct. 7, 2003.

BACKGROUND OF THE INVENTION

State of the art waterjet propulsors for marine craft utilize an impeller that pressurizes water supplied to the impeller from a water inlet. The pressurized water than passes through a stator that has fixed vanes to straighten out the water flow exiting the impeller. After exiting the stator, the pressurized water passes through a water-accelerating nozzle to thereby generate propulsive thrust. This type of waterjet propulsor is called a pressurized system waterjet here.

A shortcoming of these existing pressurized system waterjet designs is that they suffer serious performance falloff when air or other gas is included in their inlet fluid flow. Tests run on pressurized system waterjets at Pratt & Whitney Aircraft in the sixties showed that serious loss of performance resulted from as little as three to five percent of air or other gases by volume of total inlet fluid flow. This is because the compressible gas degrades the efficiency of the waterjet's water pressurizing impeller. Two primary sources of air entrained in the inlet water of a waterjet are due to: 1) Boats operating in rough seas where air flow is trapped under the hull and passes into the waterjet inlet and 2) Air cushioned boats where the underside of the hulls are partially aerated as a normal condition of operation.

As a point of interest, some of Applicant's earlier work, such as given in the continuation-in-part applications listed under a preceding section titled CROSS REFERENCE TO OTHER APPLICATIONS, revolve around enclosed or semi-enclosed rotor propulsors that operate partially aerated as a preferred condition. Such units are designed to operate as mainly non-pressurized systems with their rotors aerated. As such, it is normally not necessary to bleed off entrained air or gas in their water inlets.

A second shortcoming of existing waterjets is that, in boats with multiple waterjet propulsors, the drag or resistance of a non-operating waterjet becomes very high as boat speed is increased. This is due to the resistance of the water flow passing through the non-operating waterjet.

The instant invention addresses both of the aforementioned shortcomings of existing state-of-the-art pressurized system waterjets. This is accomplished by offering a way to bleed off part or all of the air in the waterjet inlet water and a way to deflect at least most of the water from entering the inlet of a non-operating waterjet when moving forward a high speeds. A further enhancement is the use of air fences that restrict water containing entrained air from entering from the sides of the waterjet's water inlet. For purposes of this application, high speed is defined as being fifteen knots or higher.

SUMMARY OF THE INVENTION

With the foregoing in mind, it is a principal object of the present invention to provide an improved waterjet propulsor for marine craft that has a boundary layer bleed opening disposed, at least in its majority, forward of the waterjet propulsor's powered rotor, said boundary layer bleed opening taking in aerated boundary layer water thereby reducing the amount of air entering the powered rotor during high speed forward operation of the marine craft.

A related object of the invention is that the boundary layer bleed opening extends, as a sum of its openings, over a majority of a width of the waterjet's fluid inlet.

A further object of the invention is that aerated boundary layer water taken in by the inlet boundary layer bleed opening passes through a valve that controls flow of the aerated boundary layer water.

Yet another object of the invention is that the aerated boundary layer water taken in by the inlet boundary layer bleed opening passes through a bypass pump that accelerates flow of the aerated boundary layer water.

Another related object of the invention is that at least a portion of the aerated boundary layer water taken in by the inlet boundary layer bleed opening be dispensed or discharged into the waterjet propulsor downstream of the waterjet rotor.

A directly related object of the invention is that at least a portion of the aerated boundary layer water taken in by the boundary layer bleed opening be dispensed or discharged from a stator vane assembly disposed downstream of the waterjet rotor.

Another related object of the invention is that at least a portion of the aerated boundary layer water taken in by the boundary layer bleed opening be dispensed or discharged from a waterjet nozzle of the improved waterjet propulsor.

A further object of the invention is that there be a first air fence disposed, at least in its majority, to one side of the waterjet fluid inlet.

A directly related object of the invention is that there be a second air fence disposed, at least in its majority, to an opposite side of the waterjet fluid inlet from the first air fence.

Yet another object of the invention is that it include an inlet flow deflector that, when extended, deflects fluid flow from entering the waterjet fluid inlet.

A directly related object of the invention is that force for movement of the inlet flow deflector be provided by a powered actuated.

A further related object of the invention is that the inlet flow deflector, as a sum of its parts, extend over a majority of a width of the waterjet fluid inlet.

Yet one more object of the invention is that the instant invention waterjet propulsor can be a pressurized system waterjet.

The invention will be better understood upon reference to the drawings and detailed description of the invention which follow in which:

DETAILED DESCRIPTION

Figure 1:
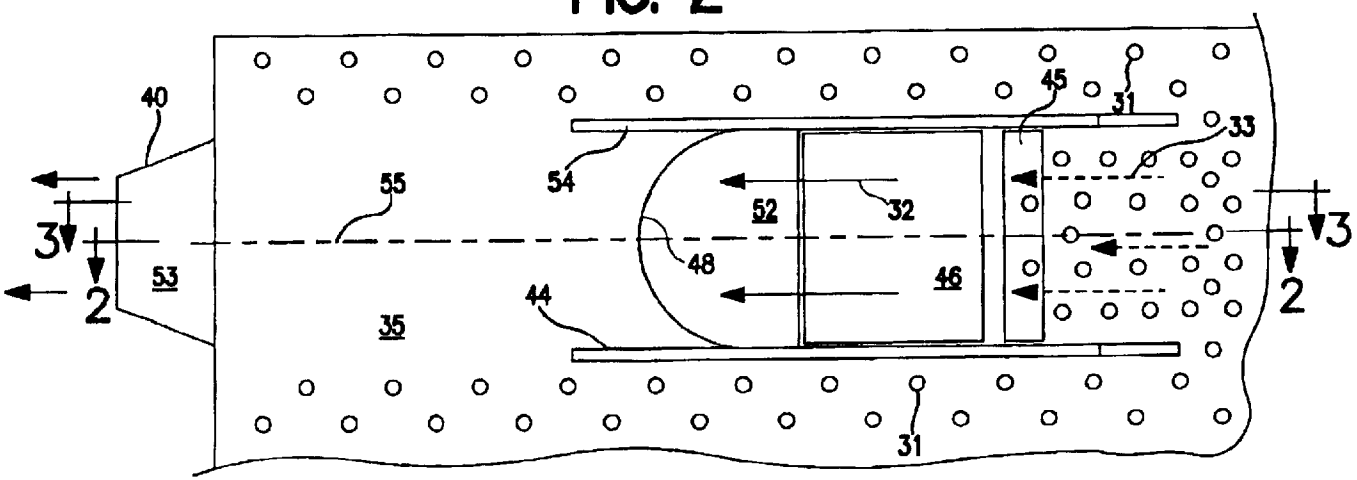
FIG. 1 presents a partial underside plan view of an instant invention waterjet propulsor as installed in a boat hull.

FIG. 1 presents a bottom plan view of the instant invention waterjet propulsor 53 installed in a boat hull 35 that is shown in partial section. Shown are aerated boundary layer water 31 that is passing under the boat hull 35, boundary layer bleed opening 45, water flow arrows 32, aerated boundary layer water flow arrows 33, aerated boundary layer water bleed line discharge opening 54, air fences 44, 54, waterjet inlet fluid flow deflector 46, waterjet propulsor vertical centerline plane 55, and waterjet discharge nozzle 40. Note that the aerated boundary layer forward 31 forward of the waterjet fluid inlet 52 is mostly taken in at the boundary layer bleed opening 45 here.

Figure 2:
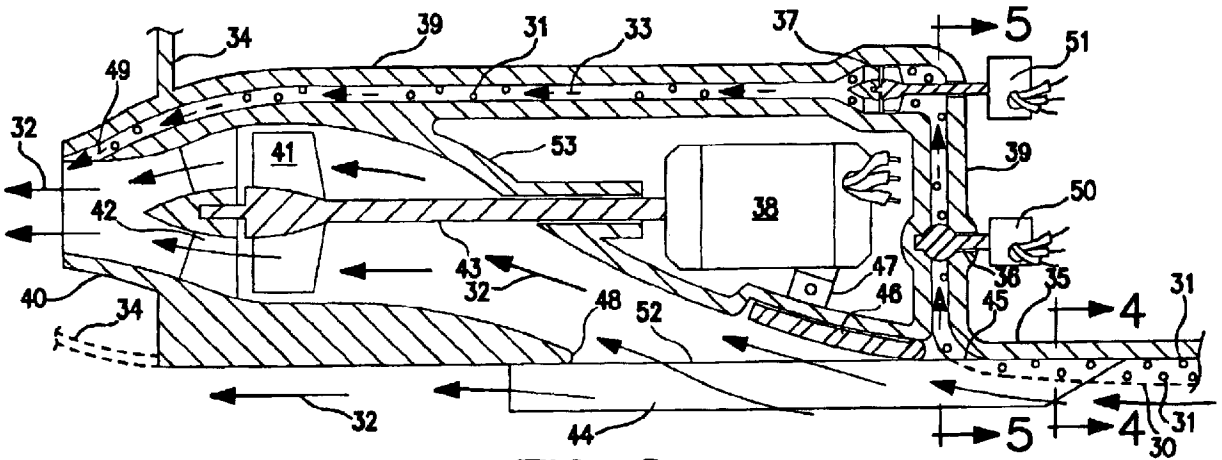
FIG. 2 is a centerline cross sectional view, as taken through vertical centerline plane line 2—2 of FIG. 1, that shows the waterjet's rotor or impeller and its drive motor, an inlet water deflector, and boundary layer air bleed mechanism in a preferred embodiment.

FIG. 2 is a centerline cross sectional view, as taken through the vertical centerline line 2—2 of FIG. 1, of the instant invention showing an aerated boundary layer bleed line 39 that takes in aerated boundary layer water 31 at its boundary layer bleed opening 45. The boundary of the aerated water is roughly depicted by boundary layer line 30. In this elaborated version of the instant invention, the aerated boundary layer water passes through a bypass valve 36 that is operated by a bypass valve powered actuator 50 and a bypass or boost pump 37 that is powered by bypass pump motor 51. The discharge of the aerated boundary layer water 31 is normally accomplished by dumping it into the waterjet nozzle 40 at the aerated boundary layer water bleed line discharge 54. This creates an aspirating effect on the aerated boundary layer water 31 in the bleed line 39. However, it is not necessary to have the aerated boundary layer discharge into the waterjet nozzle to make a workable system since, in this instance, the optional bypass pump 37 provides energy to move the fluids in and discharge the fluids from the aerated water boundary layer bleed line 39.

The actual waterjet propulsor rotor or impeller 41 is driven by its motor 38 through shaft 43. Note that the three motors or actuators, 38, 50, and 51 are not shown in cross section to simplify the drawings. Discharge from the waterjet impeller 41 normally would pass through a flow straightening stator assembly 42 and then out a waterjet nozzle 40. The accelerated fluid discharge from the waterjet nozzle 40 produces the waterjet's thrust.

Other items shown in FIG. 2 include a waterline 34, an air fence 44, waterjet inlet fluid flow deflector 46, and waterjet inlet fluid flow deflector actuator 47.

Figure 3:
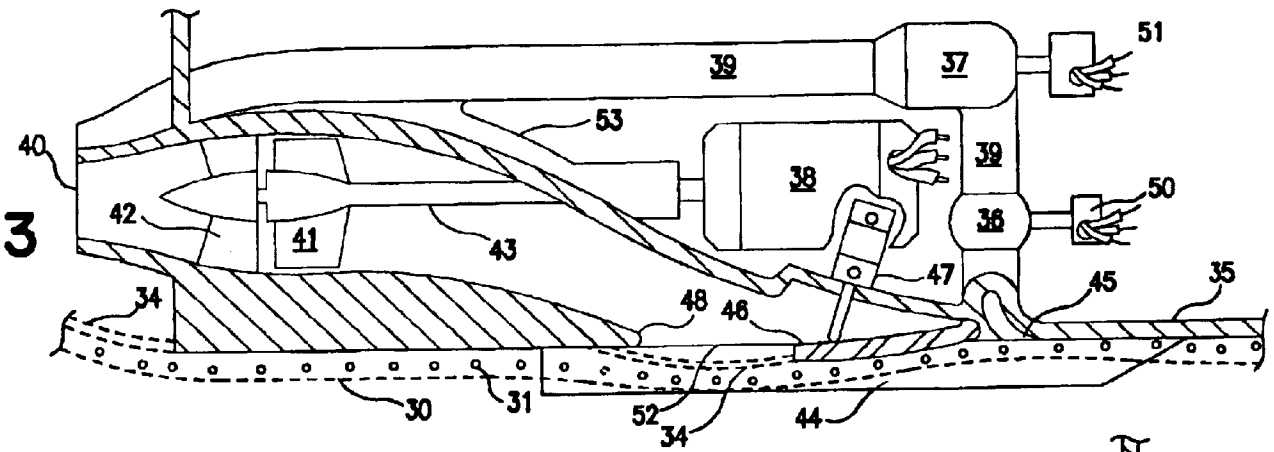
FIG. 3 is another cross-sectional view of the instant invention waterjet propulsor, as taken through line 3—3 of FIG. 1, that illustrates the water flow pattern with the inlet fluid flow deflector extended so that it prevents all or at least most of oncoming water from impacting the waterjet's inlet opening. This is a desirable condition to reduce drag when operating at high boat speeds with a waterjet not operating.

FIG. 3 is a cross-sectional view, as taken though line 3—3 of FIG. 1, that presents a view to one side of a vertical centerline plane 55 of the instant invention waterjet propulsor 53. Note that in this instance the waterjet inlet fluid deflector 46 is extended to thereby deflect at least most of the passing fluids from entering the waterjet fluid inlet 52. While, the waterjet inlet lip 48 is actually not impacted by passing fluids in this example it is possible that at least some impact on the waterjet inlet lip 48 will occur. In any case, the ability to deflect fluids from entering the waterjet fluid inlet 52 is invaluable for reducing drag of a non-operating waterjet propulsor when a boat is traveling forward at high speed.

Figure 4:
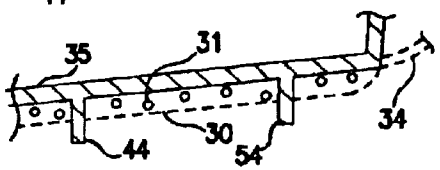
FIG. 4 presents a partial cross section, as taken through line 4—4 of FIG. 2, that shows an aerated boundary layer or air layer forward of the waterjet inlet. This view also shows air fences disposed along the boat's bottom.

FIG. 4 is a cross section, as taken through line 4—4 of FIG. 2, that shows the aerated boundary layer water 31 forward of the waterjet inlet. Note the two air fences 44; 54 here.

Figure 5:
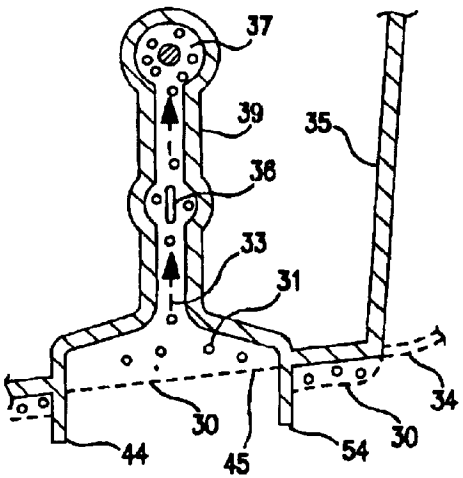
FIG. 5 gives another cross section, as taken through line 5—5 of FIG. 2, that shows a section of the aerated boundary layer bleed mechanism. This includes a bypass valve and bypass pump in this version of the instant invention.

FIG. 5 is a cross section, taken through line 5—5 of FIG. 2, that shows the aerated boundary layer water entering the boundary layer bleed opening 45. The air fences 44, 54 prevent aerated water from entering the waterjet inlet from its sides. After entering the aerated boundary layer water bleed line 39 the aerated boundary layer water bleed flow 31 passes through a bypass valve 36 and bypass pump 37 in this elaborate version of the invention.

Figure 6:
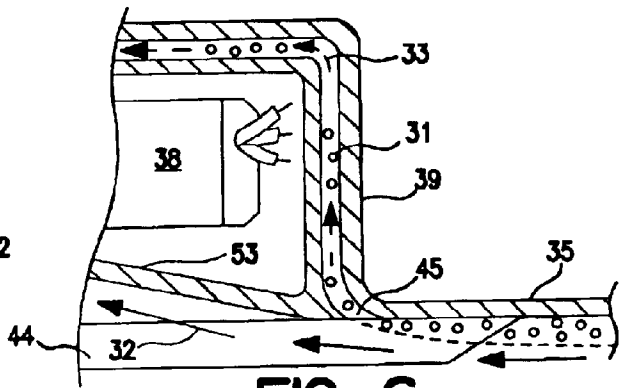
FIG. 6 is a partial cross sectional view that is the same as that given in the cross sectional view of FIG. 2 but in a simpler form. The optional bypass valve, bypass pump, and waterjet inlet fluid flow deflector have been eliminated in this simplest version of the instant invention.

FIG. 6 gives a simpler version of the invention. It is shown in the form a partial version of a similar vertical centerline plane cross section that was presented in FIG. 2. However, in this preferred embodiment version, there is no bypass valve or bypass pump in the aerated boundary layer water bleed line 39. Part of the force for moving the fluid in this case comes from the aspirating effect of the discharge nozzle fluid flow on the discharge of the fluid from the boundary layer bleed line 39 into the waterjet nozzle. For further simplicity, the optional waterjet inlet water flow deflector is eliminated here.

Figure 7:
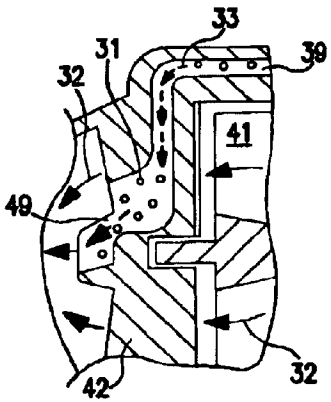
FIG. 7 presents a partial vertical centerline plane cross section, similar to that presented in FIG. 2, that shows an alternative means of dispensing the aerated boundary layer water taken in by the boundary layer bleed. In this case, the dispensing takes place from the stator vane assembly. Aspiration of the aerated boundary layer water here provides impetus for sucking the boundary layer in at the boundary layer bleed. This is the same situation as exists when the aerated boundary layer water is dispensed into the waterjet nozzle.

FIG. 7 presents, in a partial vertical centerline cross section similar to that presented in FIG. 2, an optional situation whereby the aerated boundary layer water 31 is discharged through the stator vane assembly 42. This approach is actually the most elegantly simple and a preferred embodiment since the aspirating force on the aerated boundary layer water 31 discharging from the stator vane assembly 42 is very high.

While the invention has been described in connection with a preferred and several alternative embodiments, it will be understood that there is no intention to thereby limit the invention. On the contrary, there is intended to be covered all alternatives, modifications, and equivalents as may be included within the spirit and scope of the invention as defined by the appended claims, which are the sole definition of the invention.

What I claim is:

1. In an improved waterjet propulsor for a marine craft including a waterjet fluid inlet for taking in fluids wherein said fluids are energized by a powered rotor and then discharged to produce thrust, the improvement comprising:

a boundary layer bleed opening disposed, at least in its majority, forward of the powered rotor, said boundary layer bleed opening taking in aerated boundary layer water thereby reducing the amount of air entering the powered rotor during high speed forward operation of the marine craft and a waterjet fluid inlet flow deflector that, when extended, deflects fluid flow from entering the waterjet fluid inlet.

2. The improved waterjet propulsor of claim 1 which further comprises a first air fence disposed, at least in its majority, to one side of the waterjet fluid inlet.

3. The improved waterjet propulsor of claim 2 which further comprises a second air fence disposed, at least in its majority, to an opposite side of the waterjet fluid inlet from the first air fence.

4. The improved waterjet propulsor of claim 1 wherein the boundary layer bleed opening extends, as a sum of its openings, over a majority of a width of the waterjet fluid inlet.

5. The improved waterjet propulsor of claim 1 wherein aerated boundary layer water taken in by the inlet boundary layer bleed opening passes through a bypass valve that controls flow of the aerated boundary layer water.

6. The improved waterjet propulsor of claim 1 wherein aerated boundary layer water taken in by the inlet boundary layer bleed opening passes through a bypass pump that accelerates flow of the aerated boundary layer water.

7. The improved waterjet propulsor of claim 1 wherein at least a portion of the aerated boundary layer water taken in by the inlet boundary layer bleed opening is discharged into the waterjet propulsor downstream of the waterjet rotor.

8. The improved waterjet propulsor of claim 1 wherein at least a portion of the aerated boundary layer water taken in by the boundary layer bleed opening is discharged from a stator vane assembly disposed downstream of the waterjet rotor.

9. The improved waterjet propulsor of claim 1 wherein at least a portion of the aerated boundary layer water taken in by the boundary layer bleed opening is mixed with water discharged from the powered rotor and discharged from a waterjet nozzle of the improved waterjet propulsor and wherein water passing through said powered rotor also passes through the waterjet nozzle.

10. The improved waterjet propulsor of claim 1 wherein an aft end of the waterjet fluid inlet flow deflector, when extended and as seen in a vertical longitudinal plane of the waterjet fluid inlet is substantially even with an inlet lip of the waterjet fluid inlet.

11. The improved waterjet propulsor of claim 1 wherein the waterjet inlet fluid flow deflector, as a sum of its parts, extend over a majority of a width of the waterjet fluid inlet.

12. The improved waterjet propulsor of claim 1 wherein said improved waterjet propulsor is a pressurized system waterjet propulsor.

13. In an improved waterjet propulsor for a marine craft including a waterjet fluid inlet for taking in fluids wherein said fluids are energized by a powered rotor and then discharged to produce thrust, the improvement comprising:

a boundary layer bleed opening disposed, at least in its majority, forward of the powered rotor, said boundary layer bleed opening taking in aerated boundary layer water thereby reducing the amount of air entering the powered rotor during high speed forward operation of the marine craft, and wherein the taking in of the aerated boundary layer water is aided by aspiration forces provided by pumping means.

14. The improved waterjet propulsor of claim 13 wherein the boundary layer bleed opening extends, as a sum of its openings, over a majority of a width of the waterjet fluid inlet.

15. The improved waterjet propulsor of claim 13 wherein aerated boundary layer water taken in by the inlet boundary layer bleed opening passes through a bypass valve that controls flow of the aerated boundary layer water.

16. The improved waterjet propulsor of claim 13 wherein the pumping means is a bypass pump.

17. The improved waterjet propulsor of claim 13 which further comprises a first air fence disposed, at least in its majority, to one side of the waterjet fluid inlet and a second air fence disposed, at least in its majority, to an opposite side of the waterjet fluid inlet from the first air fences.

18. The improved waterjet propulsor of claim 13 wherein at least a portion of the aerated boundary layer water taken in by the boundary layer bleed opening is discharged from a stator vane assembly disposed downstream of the waterjet rotor.

19. The improved waterjet propulsor of claim 13 wherein at least a portion of the aerated boundary layer water taken in by the boundary layer bleed opening is discharged from a waterjet nozzle of the improved waterjet propulsor and wherein water passing through said powered rotor also passes through the waterjet nozzle.

20. The improved waterjet propulsor of claim 13 which further comprises a waterjet inlet fluid flow deflector that, when extended, deflects fluid flow from entering the waterjet fluid inlet.

21. The improved waterjet propulsor of claim 20 wherein the waterjet inlet fluid flow deflector, as a sum of its parts, extend over a majority of a width of the waterjet fluid inlet.

22. The improved waterjet propulsor of claim 13 wherein said improved waterjet propulsor is a pressurized system waterjet propulsor.

23. In an improved waterjet propulsor for marine craft including a waterjet water inlet for taking in water wherein said water is energized by a powered rotor and then discharged to produce thrust, the improvement comprising: a waterjet inlet water flow deflector that, when extended, deflects at least a majority of water flow from entering the waterjet water inlet and wherein said waterjet inlet water flow deflector, when extended, covers at least a majority of the waterjet inlet and wherein said powered rotor is fully submerged in water during normal high speed forward operation of the marine craft.

24. The improved waterjet propulsor of claim 23 wherein power for actuation of the waterjet inlet water flow deflector is provided by a powered actuator.

25. The improved waterjet propulsor of claim 23 wherein an aft end of the waterjet water flow deflector, as seen in a vertical longitudinal plane of the waterjet water inlet with the waterjet water flow deflector extended, is substantially even with an inlet lip of the waterjet water inlet.

26. The improved waterjet propulsor of claim 23 which further comprises a boundary layer bleed opening disposed, at least in its majority, forward of the powered rotor, said boundary layer bleed opening taking in aerated boundary layer water thereby reducing the amount of air entering the rotor when the improved waterjet propulsor is propelling the marine craft forward at high speeds.

27. The improved waterjet propulsor of claim 26 wherein at least a portion of the aerated boundary layer water taken in by the inlet boundary layer bleed opening is discharged into the waterjet propulsor downstream of the waterjet rotor.

28. The improved waterjet propulsor of claim 26 wherein at least a portion of the aerated boundary layer water taken in by the boundary layer bleed opening is discharged from a stator vane assembly disposed downstream of the waterjet rotor.

29. The improved waterjet propulsor of claim 26 wherein at least a portion of the aerated boundary layer water taken in by the boundary layer bleed opening is mixed with water discharged from the powered rotor and discharged from a waterjet nozzle of the improved waterjet propulsor and wherein water passing through said powered rotor also passes through the waterjet nozzle.

30. The improved waterjet propulsor of claim 23 which further comprises a first air fence disposed, at least in its majority, to one side of the waterjet water inlet.

31. The improved waterjet propulsor of claim 30 which further comprises a second air fence disposed, at least in its majority, to an opposite side of the waterjet water inlet from the first air fence.

* * * * *